US005107585A

United States Patent [19]

Yonemura

[11] Patent Number: 5,107,585

[45] Date of Patent: Apr. 28, 1992

[54] CABLE CONNECTING MACHINE

[75] Inventor: Hiroshi Yonemura, Tokyo, Japan

[73] Assignee: Hirose Electric Co., Ltd., Tokyo, Japan

[21] Appl. No.: 666,615

[22] Filed: Mar. 8, 1991

[51] Int. Cl.[5] ..... H01R 43/00

[52] U.S. Cl. ..... 29/749; 29/753; 29/757; 29/760

[58] Field of Search ..... 29/749, 753, 751, 759, 29/760

[56] References Cited

U.S. PATENT DOCUMENTS 4,641,427 2/1987 Shields ..... 29/749 X 5,040,295 8/1991 Moyaert ..... 29/749 X

*Primary Examiner*—Carl E. Hall

*Attorney, Agent, or Firm*—Kanesaka & Takeuchi

[57] ABSTRACT

A cable connecting machine which includes a base member (1); a first cable retainer (E) provided on said base member for holding a first cable in place; a second cable retainer (F) provided on said base member for holding a second cable on top of said first cable; a pair of cable pressure elements (28, 29) provided on said first cable retainer such that they are vertically adjustable; a lock device (G) provided on said base member for locking said second cable retainer; and an operation mechanism (H) provided on said base member for simultaneously releasing said lock device and said first and second cable retainers.

4 Claims, 11 Drawing Sheets

CABLE CONNECTING MACHINE

BACKGROUND OF THE INVENTION

1. Field of the Invention

The present invention relates to cable connecting machines for connecting cables to a connector one upon another.

2. Description of the Prior Art

FIGS. 22–24 show a conventional cable connecting machine which includes a base plate 71 having a pair of parallel slide slots 72 and 73. The front and rear ends of a pair of guides 74 and 75 are inserted into the slide slots 72 and 73 for sliding movement to define a connector setting station 76. A pair of positioning pins 77 or 78 are provided for each guide 74 or 75. A cable retainer 79 is mounted on the base plate 71. The cable retainer 79 includes a guide block 80, a retainer pin mechanism 81, and a retainer bar 82. The guide block 80 is provided with a guide slot 83.

As FIG. 25 shows, the retainer pin mechanism 81 includes a hole 85 made on the underside of a block 84, a push pin 86 fitted into the hole 85, a rod 87 extending upwardly from the push pin 86 through the block 84, a cam 88 pivoted at 89 to the upper end of the rod 87, and a coil spring 90 for downwardly biasing the push pin 86. The retainer bar 82 is provided beneath the guide slot 83 and the push pin 81.

In operation, a protector is set in the connector setting station 76, and a flat cable is set, with the retainer bar 82 put on the cable. The cable retainer 81 is operated to hold the cable in place with the retainer bar 82. Namely, the cam 88 is turned down as shown in FIG. 26 to permit the coil spring 90 to push the push pin 86 downwardly, thereby pushing the retainer bar 82 downwardly. Another protector is set, and another flat cable is set so that its front end abuts on the cable stopper of the protector. Then, a connector is set on top of the protector. Then, the press handle is operated to lower the press block for making connection to the connector by insulation replacement.

In the above machine, however, it is difficult to set the connector because the positioning pins 77 and 78 protrude around the connector setting station 76. In addition, it is impossible to adjust the grasping power of the cable retainer 18 according to the thickness of a cable. As a result, it occurs frequently that the cable falls off from the retainer. Moreover, the second cable is set upon the first cable which has not been held properly. Consequently, the connected cables are not properly registered, resulting in poor connection.

SUMMARY OF THE INVENTION

Accordingly, it is an object of the invention to provide a cable connecting machine which permits easy setting of connectors therein.

It is another object of the invention to provide a cable connecting machine which is able to adjust the grasping power according to the thickness of a cable, thereby preventing the cable from falling off.

It is still another object of the invention to provide a cable connecting machine which prevents the second cable from being set before the first cable has been set properly, thereby preventing poor connection.

According to the invention there is provided a cable connecting machine which includes a base member; a first cable retainer provided on the base member for holding a first cable in place; a second cable retainer provided on the base member for holding a second cable on top of the first cable; a pair of cable pressure elements provided on the first cable retainer such that they are vertically adjustable; a lock device provided on the base member for locking the second cable retainer; and an operation mechanism provided on the base member for simultaneously releasing the lock device and the first and second cable retainers.

In operation, a protector is set in the connector setting station, and the first flat cable is set. The operation mechanism is then operated to hold the cable in place with the first cable retainer. Then, another protector is set, and the second flat cable is set and held in place with the second cable retainer, which is then locked with the lock device. A connector is set on top of the flat cables on the protectors and pressed for making connection by insulation replacement. The operation mechanism is then operated to release simultaneously the lock device and the first and second cable retainers.

DESCRIPTION OF THE PREFERRED EMBODIMENT

Figure 1:
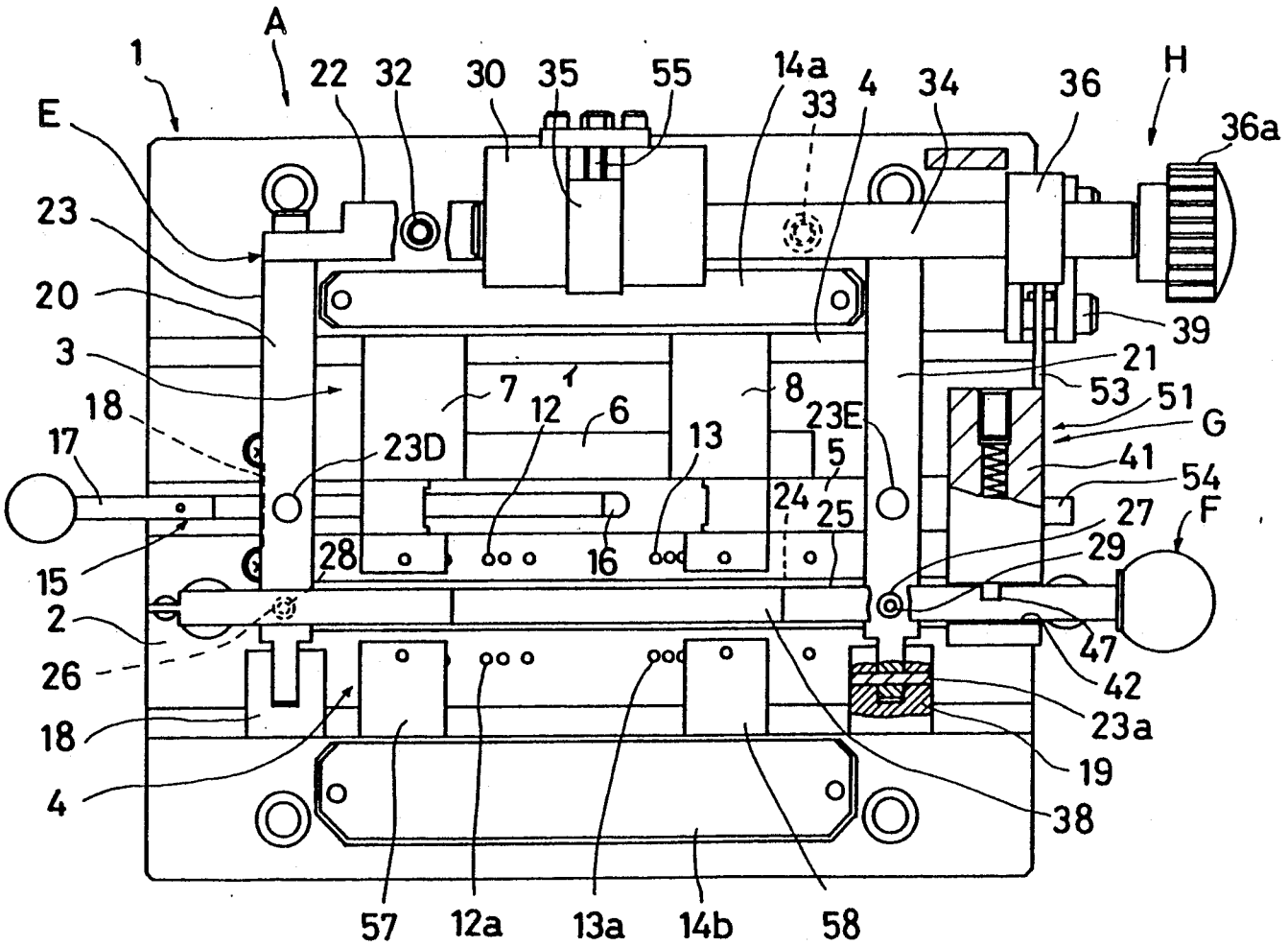
FIG. 1 is a tip plan view of a guide plate device of a cable connecting machine according to an embodiment of the invention.
Figure 2:
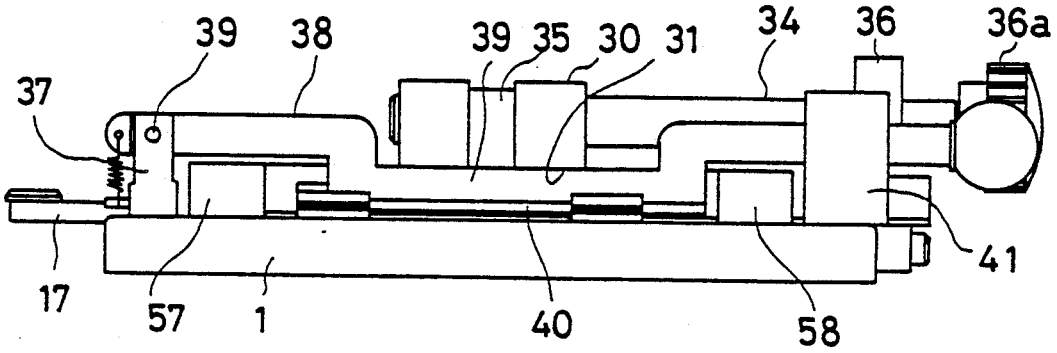
FIG. 2 is a front elevational view of the guide plate device of FIG. 1.
Figure 3:
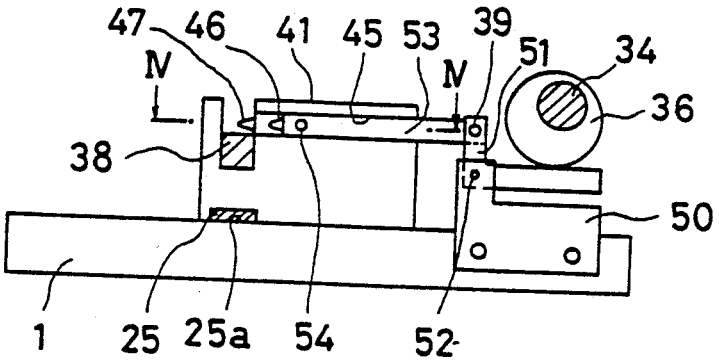
FIG. 3 is a partially omitted, side elevational view of the guide plate device of FIG. 1.
Figure 5:
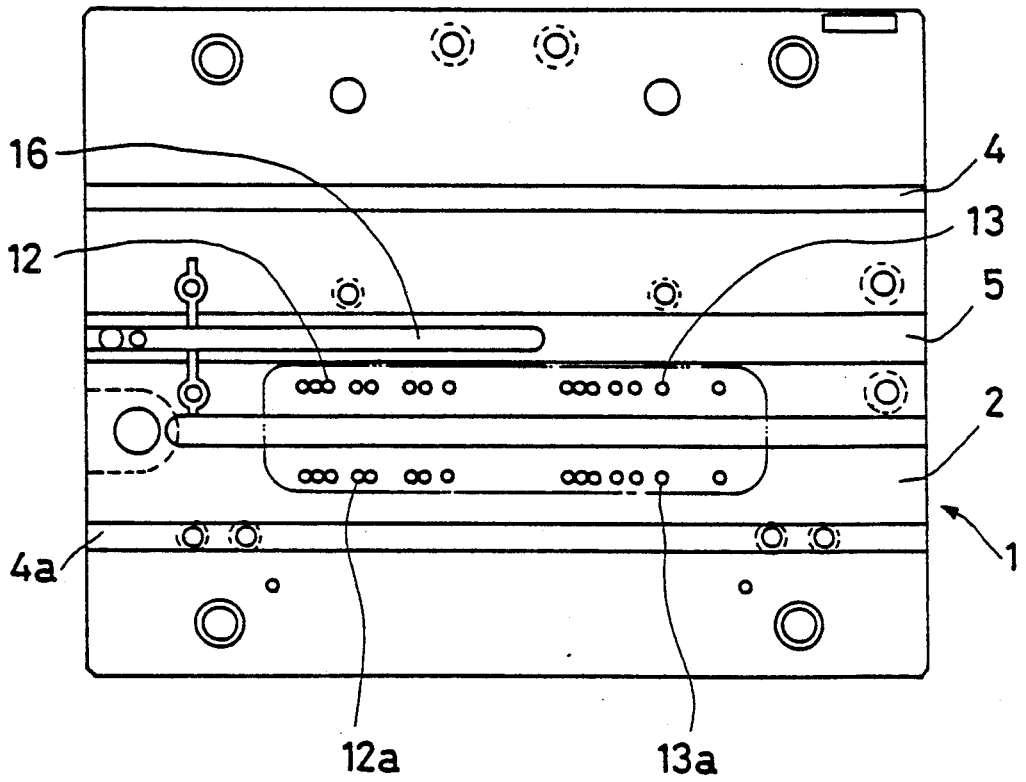
FIG. 5 is a top plan view of a base plate used in the guide plate device of FIG. 1.
Figure 6:
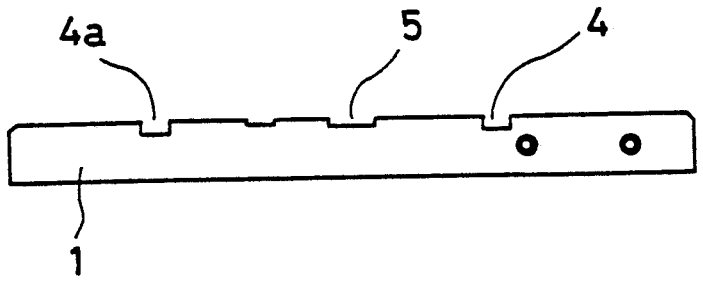
FIG. 6 is a side elevational view of the base plate of FIG. 5.

In FIGS. 1-3, a guide plate device A includes a base plate 1 on the upper surface 2 of which a connector mount 3 and a cable guide 4' are mounted. The connector mount 3 includes a pair of parallel grooves 4 and 5; a guide member 6 parallel to the grooves 4 and 5; a pair of connector guides 7 and 8; and a nameplate 14*a*. The base plate 1 is shown in detail in FIGS. 5 and 6.

Figure 7:
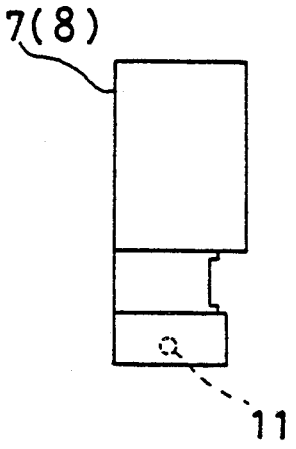
FIG. 7 is a top plan view of a connector guide used in the guide plate device of FIG. 1.
Figure 8:
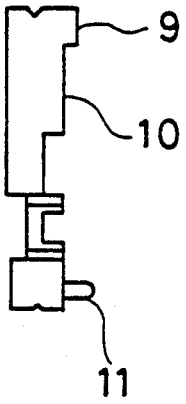
FIG. 8 is a side elevational view of the connector guide of FIG. 7.

As FIGS. 7 and 8 show, the connector guides 7 and 8 have a guide projection 9, a guide recess 10, and a guide pin 11 on the lower surface (right side in FIG. 8). These connector guides 7 and 8 are mounted on the upper surface 2 of the base plate 1 so that the guide projection 9, the guide recess 10, and the guide pin 11 are fitted into the groove 4, the guide 6, and one of guide apertures 12 or 13.

Figure 9:
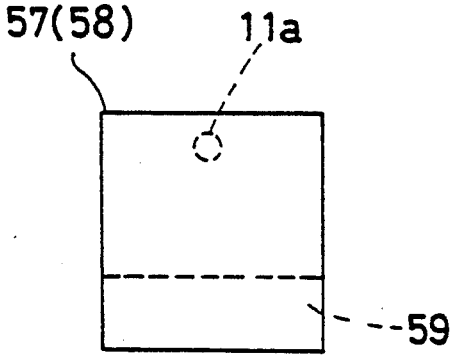
FIG. 9 is a top plan view of a cable guide used in the guide plate device of FIG. 1.
Figure 10:
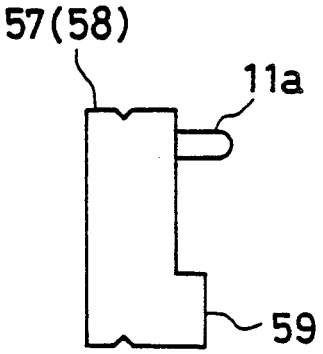
FIG. 10 is a side elevational view of the cable guide of FIG. 9.

The cable guide 4' includes a guide groove 4*a* provided on the upper surface 2, a pair of cable guides 57 and 58, and a nameplate 14*b*. As FIGS. 9 and 10 show, the cable guides 57 and 58 have a guide projection 59 and a guide pin 11*a* on the lower surface. The cable guides 57 and 58 are mounted on the upper surface 2 so that the guide projection 59 and the guide pin 11*a* are fitted into the groove 4*a* and one of pin apertures 12*a* and 13*a*, respectively.

A connector pushing mechanism 15 is provided in the groove 5. The pushing mechanism 15 has a receiving groove 16 provided on the bottom of the groove 5. A lever 17 is placed in the receiving groove 16 and pivoted at 18 so that it moves upwardly from the receiving groove 16.

A first cable retainer E, a second cable retainer F, a lock device G, and a operation mechanism H are provided on the upper surface 2 of the base plate 1. The first cable retainer E includes a U-shaped clamper 23 and a cable holder 25. The U-shaped clamper 23 has a pair of clamp bars 20 and 21 which are pivoted at 23*a* to a pair of brackets 18 and 19 and a clamp bar bridge 22 which is put across the front portions of the clamp bars 20 and 21. A rubber plate 24 is placed in parallel to the groove 5 on the upper surface 2. The cable holder 25 is placed on the rubber plate 24 by inserting it through a receiving recess 25*a* provided on the lower side of a lock holder 41 (FIG. 3).

A pair of pressure elements 28 and 29 are threaded into apertures 26 and 27 which are provided at the base portions of the clamp bars 20 and 21. These pressure elements 28 and 29 are positioned above the cable holder 25. A pair of pin hole 23D and 23E are provided on the upper surface of the clamp bars 20 and 21 for receiving a pair of pressure pins hereinafter described.

The second cable retainer F includes a clamp arm 38 with the left end portion pivoted at 39 to a clamp shaft 37 which is secured on the left side of the upper surface 2. The middle portion of the clamp arm 38 is bent downwardly to form a press section on which a rubber pressure member 40 is attached.

The lock device G includes a clamp arm lock mechanism 51 mounted on the right side of the upper surface 2. The lock mechanism 51 includes a lock holder 41 having a receiving recess 42 on which the clamp arm 38 rests.

Figure 4:
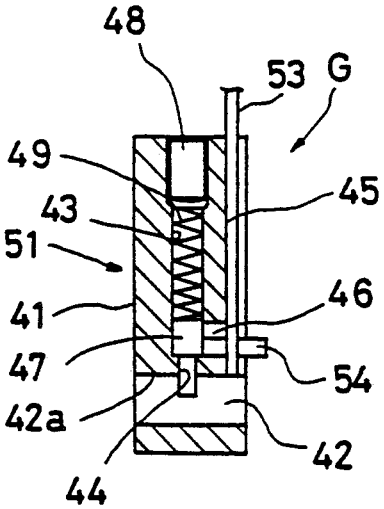
FIG. 4 is a sectional view taken along line IV—IV of FIG. 3.

As FIG. 4 shows, the lock holder 41 has a longitudinal hole 43 with a reduced pin hole 44 which communicates with the receiving recess 42 on a side 42*a*. A guide recess 45 is formed on the right side of the lock holder 41. A side hole 46 is provided on the guide recess 45 such that it communicates with the longitudinal hole 43. A lock pin 47 with a reduced front portion is provided within the longitudinal hole 43. A stopper 48 is fitted into the rear portion of the longitudinal hole 43 to place a coil spring 49 between the stopper 48 and the lock pin 47. Consequently, the coil spring 49 biases the lock pin 47 forwardly so that the lock pin 47 projects through the pin hole 44 into the receiving recess 42.

The operation mechanism H includes a cam support 30 mounted on the upper middle portion of the upper surface 2. The cam support 30 has a stopper 31 on the lower side. A pair of coil springs 32 and 33 are provided between the upper surface 2 and the clamp bar bridge 22 to bias the clamper 23 upwardly until the clamp bar bridge 22 abuts on the stopper 31. A cam shaft 34 is pivoted to the cam support 30. A clamp operation cam 35, a lever operation cam 36, and a handle 36*a* are attached to the cam shaft 34. These cams 35 and 36 are 180 degrees out of phase. The clamp operation cam 35 abuts on the upper surface of the clamp bar bridge 22. A stopper 55 is provided on the cam base 30 to limit the rotation of the clamp cam 35 to 90 degrees. A support bracket 50 is mounted on the right side of the base plate 1. An L-shaped lever 51 is pivoted at 52 to the support bracket 50 for swinging motion. The rear end of a link 53 is pivoted at 39 to the upper end of the lever 51. This link 53 is fitted in the guide recess 45 of the lock holder 41 for sliding motion. The front end of the link 53 is pivoted to the lock pin 47 with a pin 54 which extends through the side hole 46. The lever cam 36 abuts on the upper surface of the lever 51.

Figure 11:
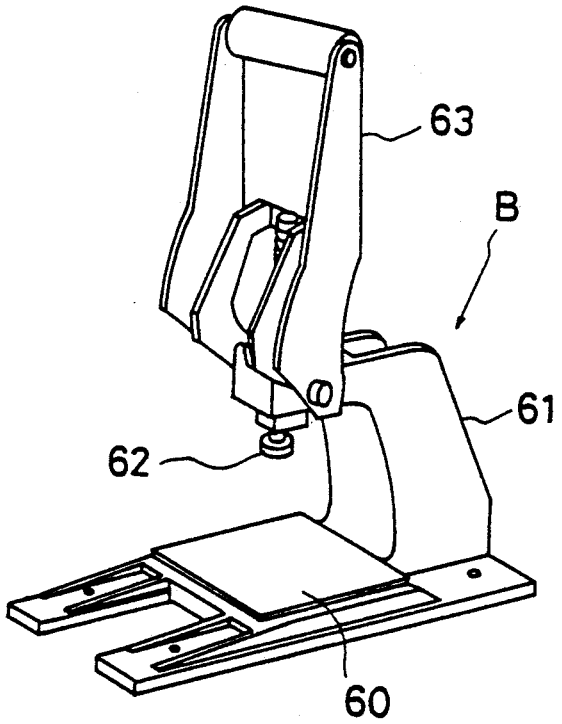
FIG. 11 is a perspective view of a connection press according to an embodiment of the invention.

As FIG. 11 shows, a connection press B includes a base 60, a support 61 extends upwardly from the base 60, a block attaching member 62 attached to the support 61 for vertical movement with upward biasing, and a handle 63 secured to the support 61 for lowering the block attaching member 62.

Figure 12:
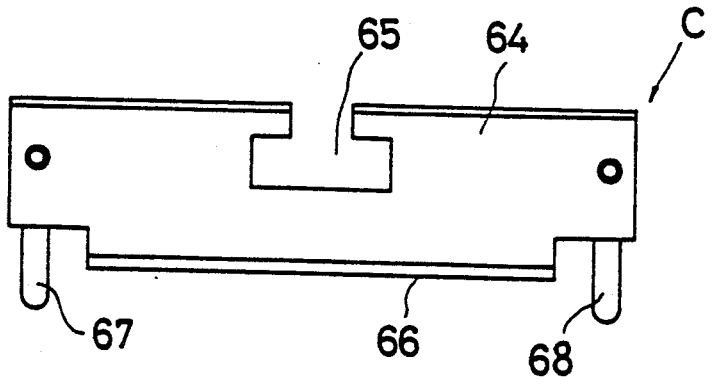
FIG. 12 is a front elevational view of a pressure block useful for the connection press of FIG. 11.

As FIG. 12 shows, a pressure block C includes a block body 64, a linkage recess 65 provided on the upper surface of the block body 64, a stamping surface 66 at the bottom, and a pair of pins 67 and 68 extending downwardly from the bottom of the block body 64.

Connection of Cables

(1) Tool Setting

The guide plate device A is set on the base 60 of the connection press B. The pressure block C is attached to the connection press B by fitting the block attaching member 62 into the linkage recess 65 of the pressure block C. The guide plate device A is secured to the base 60 with bolts at the position that it meets the pressure block C.

(2) Pole Number Setting

Figure 13:
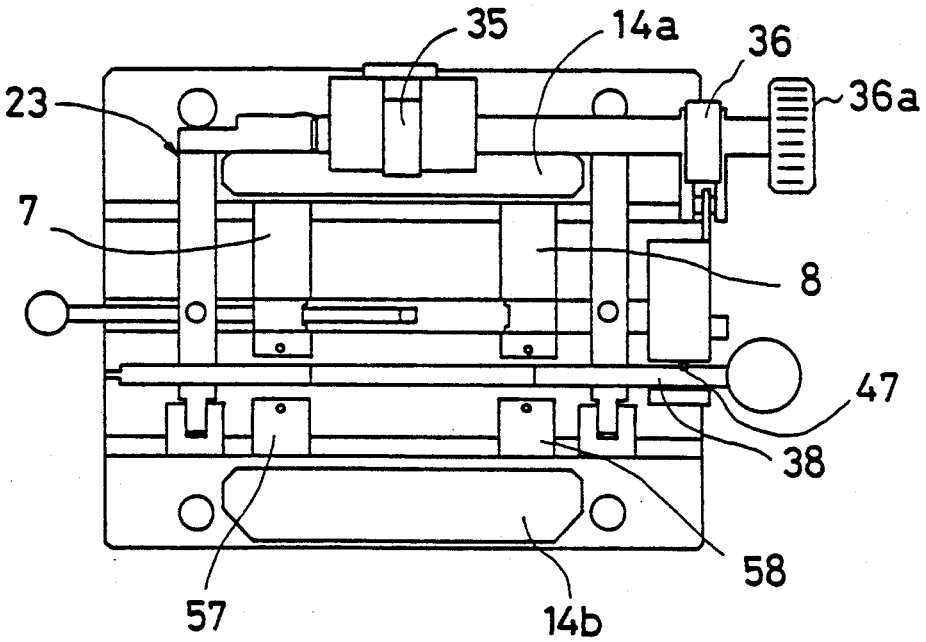
FIG. 13 is a top plan view of the guide plate device useful for explaining how to set a pole number.

The guide plate device A is of the universal type which is useful between 20 and 100 poles. In FIG. 13, the connector guides 7 and 8 are adjusted so that the inner lines of the connector guides 7 and 8 register with the lines of pole number of the nameplate 14*a*. Similarly, the cable guides 57 and 58 are adjusted so that the inner lines of the cable guides 57 and 58 register with the lines of pole number of the nameplate 14*b*.

Figure 14:
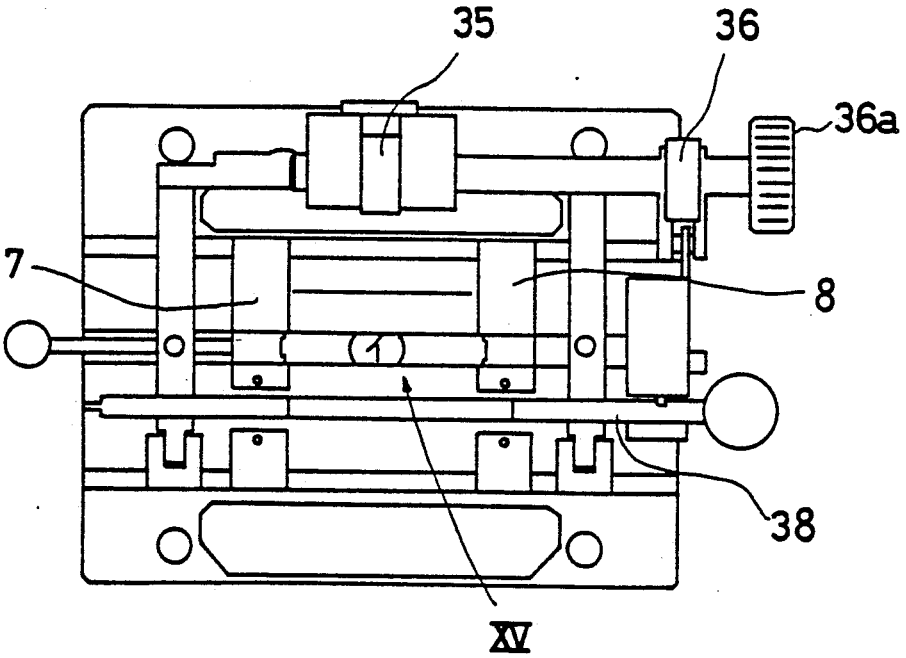
FIG. 14 is a top plan view of the guide plate device useful for explaining how to set a protector.
Figure 15:
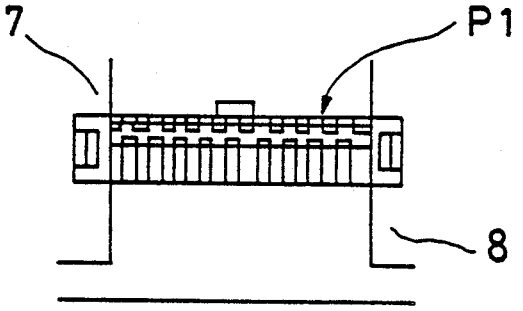
FIG. 15 is an enlarged view of the section XV of FIG. 14.
Figure 16:
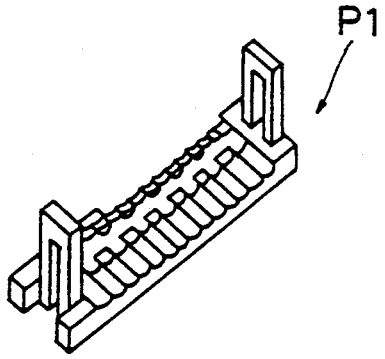
FIG. 16 is a perspective view of a protector.

(3) Cable Connection Procedure (a) As FIG. 14–16 show, a protector P1 is set in the connector setting section (λ) of the guide plate device A.

Figure 17:
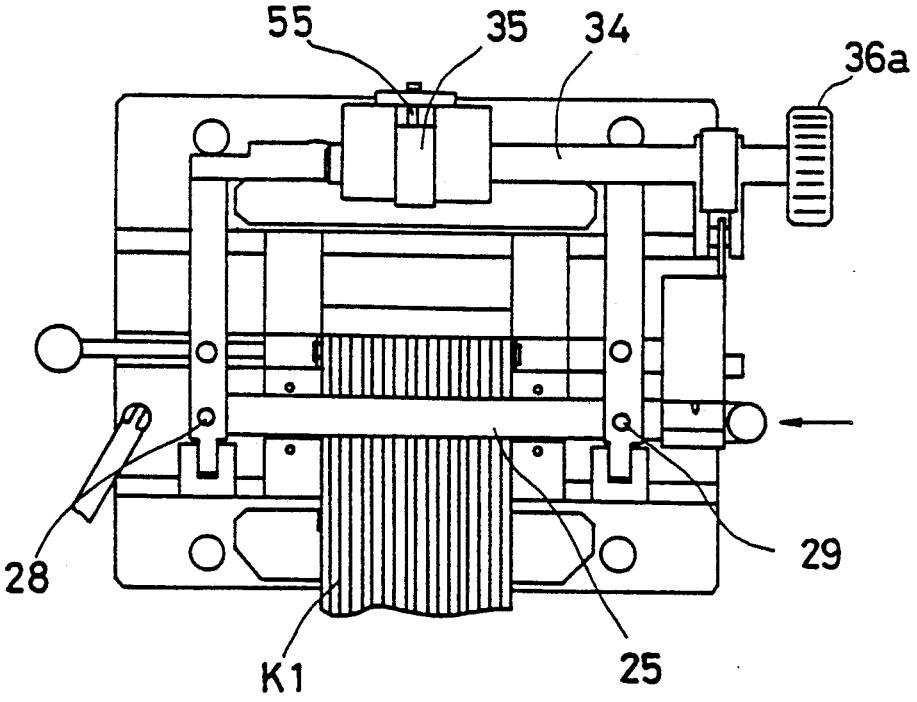
FIG. 17 is a top plan view of the guide plate device useful for explaining how to set the first flat cable.

(b) As FIG. 17 shows, the first cable K1 is set, and the cable holder 25 is placed on the cable K1.

(c) The handle 36*a* is turned counterclockwise to turn the clamp cam 35 until it hits the stopper 55 so that the clamper 23 is lowered to clamp the cable holder 25 with the pressure elements 28 and 29.

Figure 18:
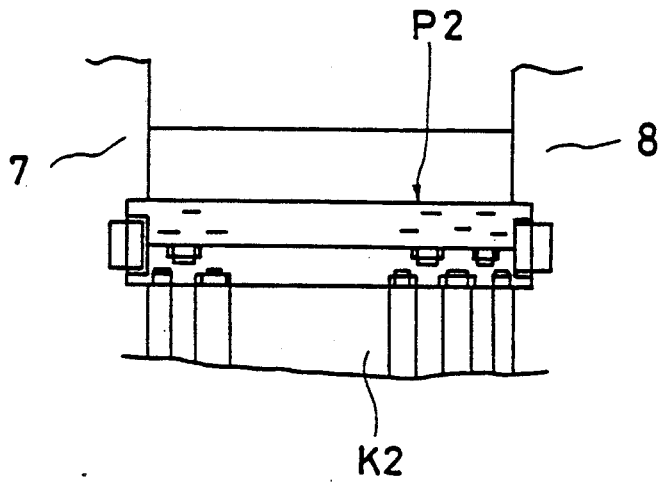
FIG. 18 is an enlarged view of another protector set in the guide plate device.

(d) As FIG. 18 shows, another protector P2 is set.

Figure 19:
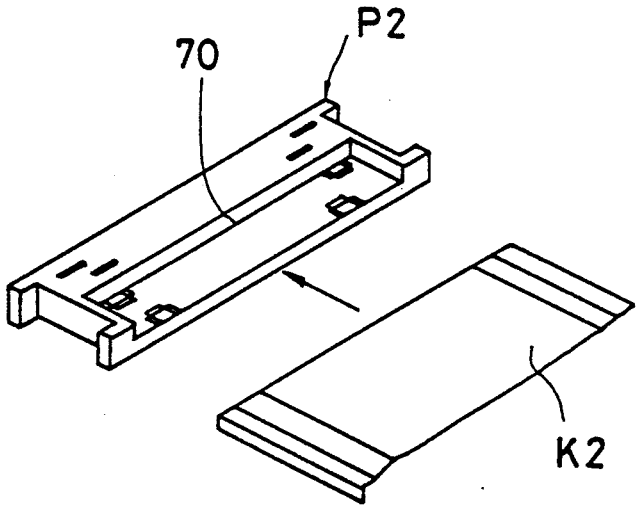
FIG. 19 is a perspective view useful for explaining how to set a falt cable in the protector.

(e) As FIG. 19 shows, the second cable K2 is set such that it abuts against the cable stopper 70 of the protector P2.

Figure 20:
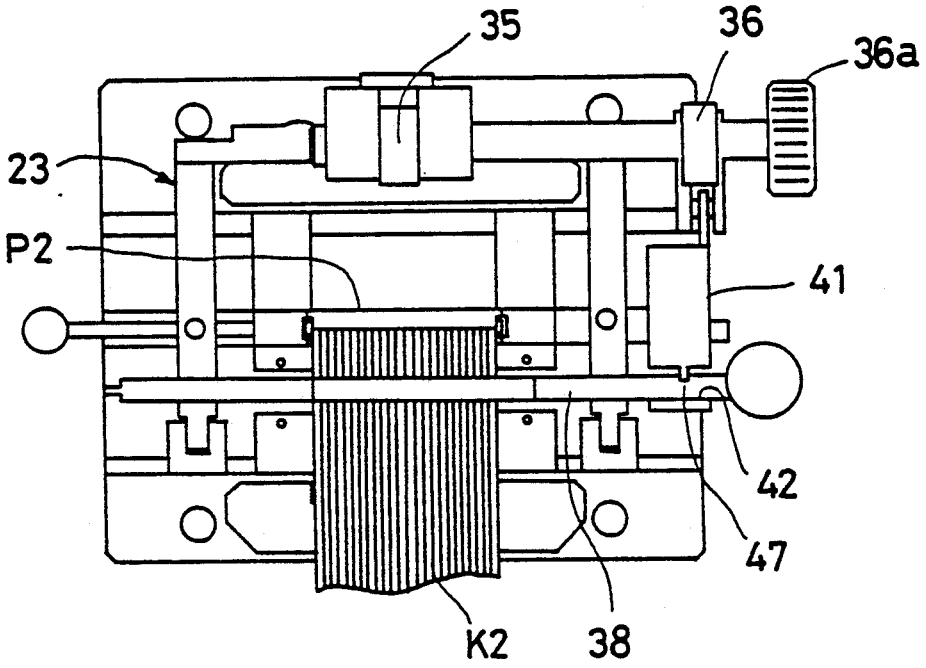
FIG. 20 is a top plan view of the guide plate device useful for explaining how to set the second flat cable.

(f) As FIG. 20 shows, the clamp arm 38 is locked into the receiving recess 42 of the lock holder 41 to hold the cable K2 in place. That is, as it is inserted into the recess 42, the clamp arm 38 pushes laterally the lock pin 47 against the coil spring 49 and then is locked by the lock pin 47 thereunder.

Figure 21:
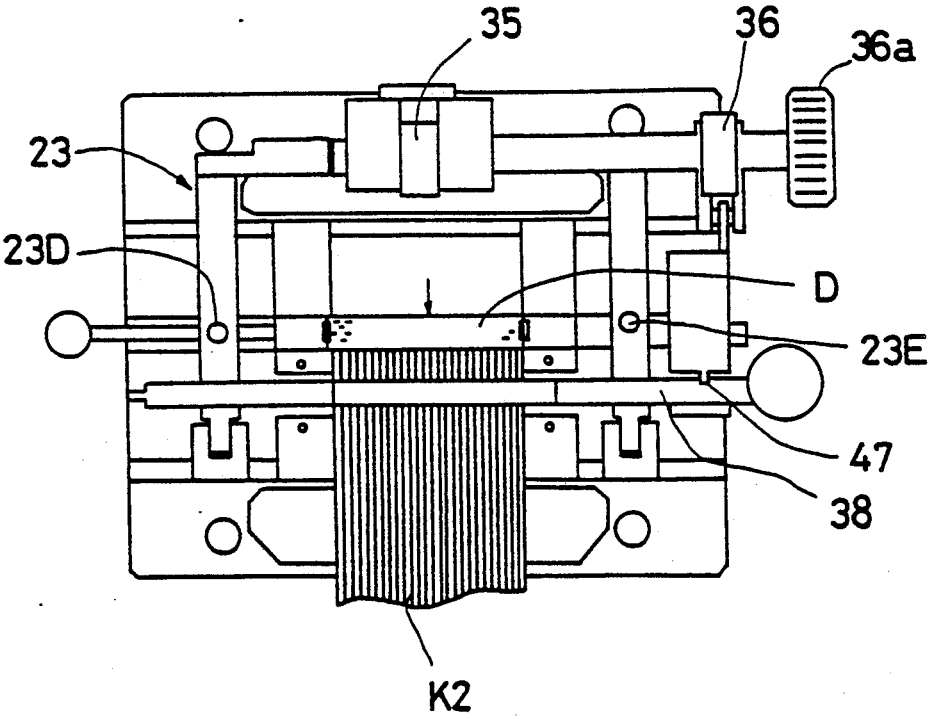
FIG. 21 is a top plan view of the guide plate device useful for explaining how to set a connector.
Figure 22:
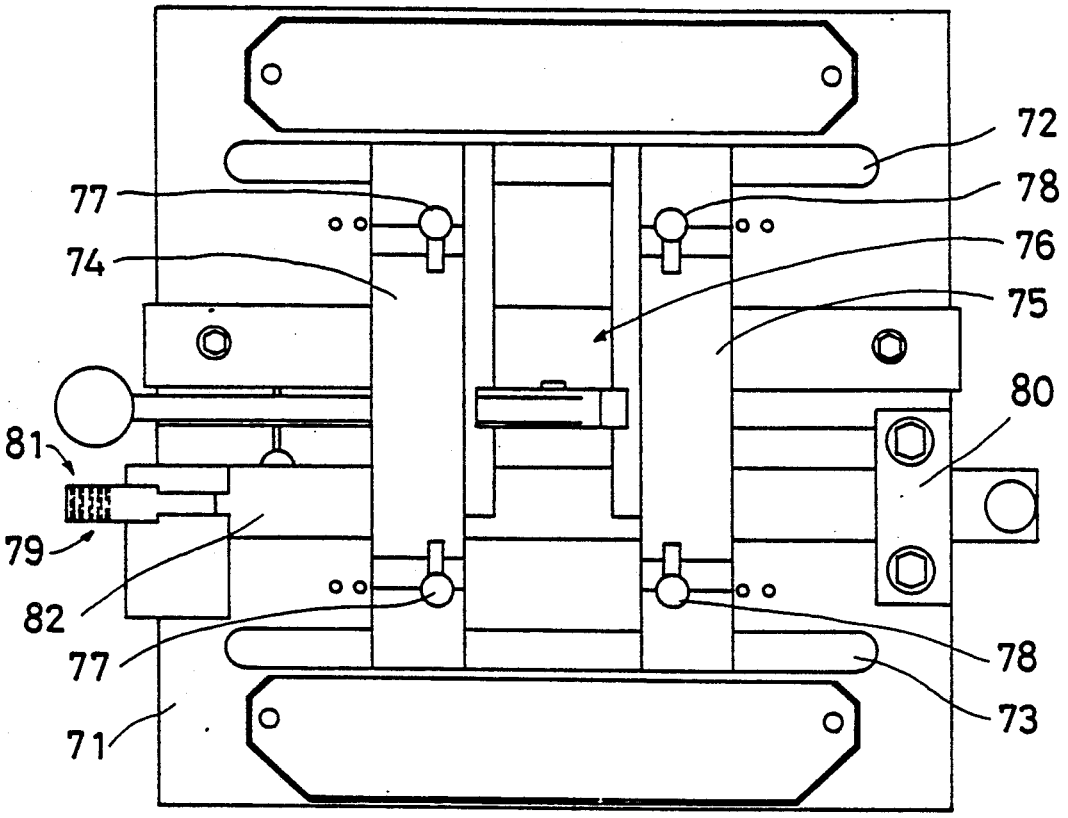
FIG. 22 PRIOR ART
FIG. 22 is a top plan view of a conventional guide plate device for a connection machine.
Figure 23:
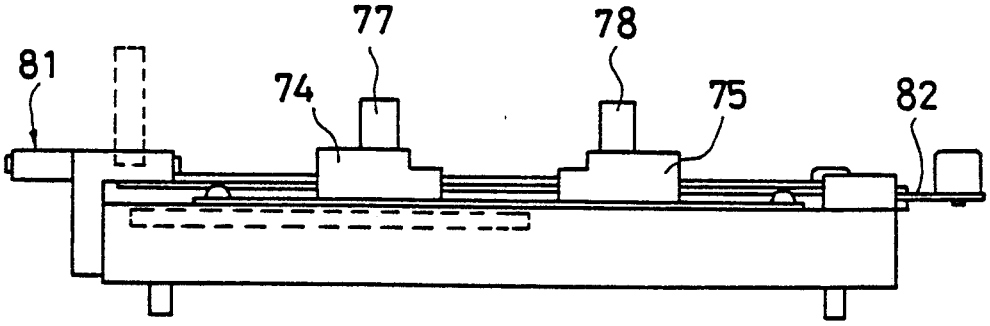
FIG. 23 PRIOR ART
FIG. 23 is a front elevational view of the conventional guide plate device.
Figure 24:
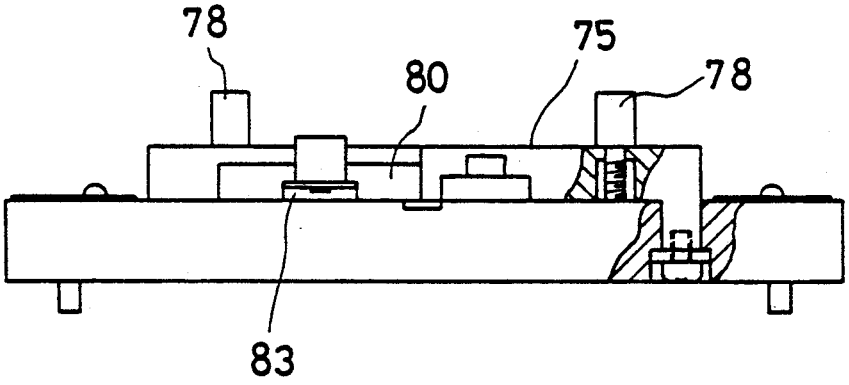
FIG. 24 PRIOR ART
FIG. 24 is a side elevational view of the conventional guide plate device.
Figure 25:
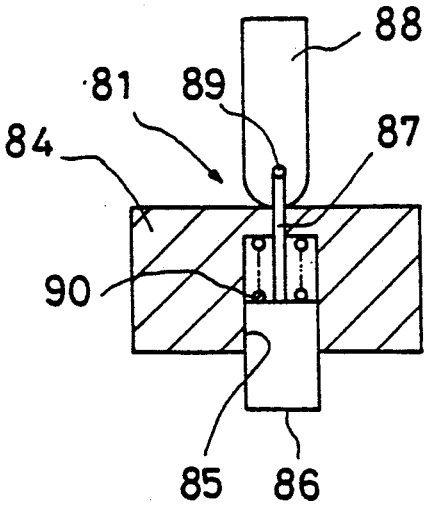
FIG. 25 PRIOR ART
FIGS. 25 and 26 are sectional views of a holder pin mechanism of the conventional guide plate device.
Figure 26:
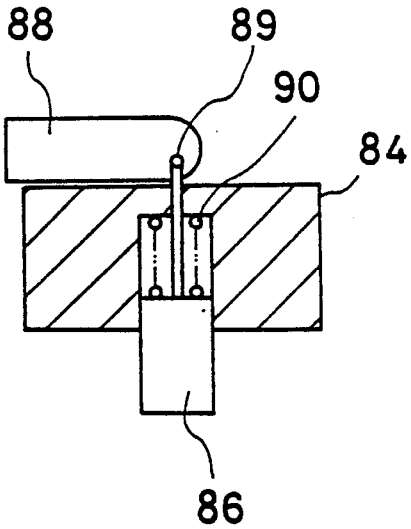
FIG. 26 PRIOR ART

(g) As FIG. 21 shows, a connector D is set on the second cable K2 so that the U-shaped contact portions of the connector D are fitted into the terminal holes of the protector P2, with the long terminals aligned on the side of an arrow.

(h) The handle 63 of the connector press B is operated to lower the pressure block C so that the pins 67 and 68 of the pressure block C is inserted into the pin holes 23D and 23E of the clamper 23. When the handle is further lowered, the connector press B presses the connector D with the stamping face 66 of the pressure block C for making connection by insulation displacement. Upon completion of the connection, the pressure block C is raised.

(i) The handle 36*a* is then turned clockwise to release the clamp of the clamper 23 by the clamp cam 35 and turn the lever 51 backwardly to retreat the lock pin 47 against the coil spring 49, thereby releasing the lock of the clamp arm 38 by the lock pin 47.

(j) The clamp arm 38 is removed from the receiving recess 42, and the cable holder 25 is removed to release the retention of the cables K1 and K2. The lever 17 of the connector push mechanism 15 is operated to turn the lever 17 about the fulcrum 18, thereby ejecting the connector D with the cables from the connector setting stage (λ).

As has been described above, the connector guides 7 and 8 are mounted on the base plate 1 such that the guide projections 9, the guide recesses 10, and guide pins 11 are fitted into the groove 4, the guide 6, and the pin holes 12 and 13 while the cable guide 57 and 58 are mounted on the base plate 1 such that the guide projections 59 and the guide pins 11*a* are fitted into the groove 4*a* and the pin holes 12*a* and 13*a*, so that there are no projections around the connector setting stage (λ), making it easy to set the protectors P1 and P2, the cables K1 and K2, and the connector D.

The pressure elements 28 and 29 are threaded to the clamp bars 20 and 21 so that by turning the pressure elements it is possible to adjust the grasping power of the cable holder 25 according to the cable thickness. The first cable K1 is held in place by the first cable retainer E and the second cable K2 is held in place by the second cable retainer F, which in turn is locked by the lock device G before the connector D is pressed for connection by insulation replacement so that it is possible to eliminate the poor connection caused by the overlook that the first cable retainer is not used.

In addition, the handle 36*a* of the cam shaft 34 is turned clockwise to release the clamp of the clamper 23 by the clamp cam 35 while the lever cam 36 turns the lever 51 backwardly to retreat the lock pin 47 against the coil spring 49, thereby releasing the lock of the clamp arm 38 by the lock pin 47. By operating the operation mechanism H in this way it is possible to simultaneously release the lock by the lock device G and the cable retention by the first and second cable retainers E and F.

As has been described above, the connector and cable guides are positioned on their backsides so that there are no projections around the connector setting station, resulting in easy setting of protectors, cables, and connectors. In addition, by adjusting the vertically adjustable pressure elements, it is possible to adjust the cable grasping power according to the thickness of a flat cable, preventing the cable from falling off from the retainer.

The operation mechanism is operated to hold the first cable in place with the first cable retainer and the second cable in place with the second cable retainer, which is locked by the lock device, and a connector is pressed for making connection by insulation replacement, for example, thereby eliminating the poor connection which can be caused by the overlook that the first cable retainer is not applied. By operating the operation mechanism, it is possible to release simultaneously the lock device and the first and second cable retainers.

I claim:

1. A cable connecting machine comprising:

a base member;

a first cable retainer provided on said base member for holding a first cable in place;

a second cable retainer provided on said base member for holding a second cable on top of said first cable;

a pair of cable pressure elements provided on said first cable retainer such that said pressure elements are vertically adjustable;

a lock device provided on said base member for locking said second cable retainer; and an operation mechanism provided on said base member for simultaneously releasing said lock device and said first and second cable retainers.

2. The cable connecting machine of claim 1, which further comprises a pair of connector guides mounted on said base such that guide projections, guide recesses, and guide pins are fitted into groove, guide, and pin holes of said base and a pair of cable guides mounted on said base such that guide projections and guide pins thereof are fitted into groove and pin holes of said base, so that there are no projections around a connector setting stage thus making it easy to set protectors, cables, and a connector.

3. The cable connecting machine of claim 1, wherein said pressure elements are threaded to clamp bars so that by turning said pressure elements it is possible to adjust a grasping power of a cable holder according to a cable thickness.

4. The cable connecting machine of claim 1, wherein said lock device locks said second cable retainer before a connector is connected so that it is possible to eliminate poor connection caused by overlook that said first cable retainer is not used.

* * * * *